US012674257B2

(12) United States Patent
Vela

(10) Patent No.: US 12,674,257 B2
(45) Date of Patent: Jul. 7, 2026

(54) CROCHET ASSISTANCE APPARATUS

(71) Applicant: James Edward Vela, Maitland, FL (US)

(72) Inventor: James Edward Vela, Maitland, FL (US)

( * ) Notice: Subject to any disclaimer, the term of this patent is extended or adjusted under 35 U.S.C. 154(b) by 0 days.

(21) Appl. No.: 19/262,939

(22) Filed: Jul. 8, 2025

(65) Prior Publication Data

US 2025/0333884 A1 Oct. 30, 2025

Related U.S. Application Data

(63) Continuation-in-part of application No. 18/960,781, filed on Nov. 26, 2024, now Pat. No. 12,454,777, which is a continuation-in-part of application No. 18/671,464, filed on May 22, 2024, now Pat. No. 12,247,333.

(60) Provisional application No. 63/470,284, filed on Jun. 1, 2023.

(51) Int. Cl.
*D04B 33/00* (2006.01)
*D04B 3/04* (2006.01)

(52) U.S. Cl.
CPC ..... *D04B 33/00* (2013.01); *D04B 3/04* (2013.01)

(58) Field of Classification Search
CPC ... D04B 3/04; D04B 3/00; D04B 3/06; D04B 5/00; D04B 31/00; D04B 33/00; D04B 39/00
USPC ..... 66/1 R, 1 A, 3, 4
See application file for complete search history.

(56) References Cited

U.S. PATENT DOCUMENTS 248,669 A * 10/1881 Sackett ..... D04B 33/00 289/16.5
1,168,554 A * 1/1916 Riley ..... D04B 17/00 66/1 R
1,208,085 A * 12/1916 Branley ..... B65H 57/04 242/153
1,473,953 A * 11/1923 Dart ..... D05B 91/04 D3/29
2,072,668 A * 3/1937 Eltgroth ..... D04B 17/00 D15/66
2,142,608 A * 1/1939 Hockert ..... D04B 3/00 66/1 A
2,434,609 A * 1/1948 Coffey ..... D04B 3/00 43/25
2,524,157 A * 10/1950 Beirer ..... D04B 3/00 242/157 R (Continued)

*Primary Examiner* — Danny Worrell
(74) *Attorney, Agent, or Firm* — PATENTFILE, LLC; Bradley C. Fach; Steven R. Kick

(57) ABSTRACT

A crochet assistance apparatus may include a lower arm that may be coupled to a base shaft. A central shaft and a central arm may be coupled to the base shaft. A guide shaft may be coupled to the base shaft and the central shaft, and an upper arm and a guide support may be coupled to the guide shaft. The guide support may be positioned to be relatively farther from the central shaft than the upper arm is positioned from the central arm. The guide support may include a distal guide surface and a proximal guide surface, and the proximal guide surface may be positioned to be relatively closer to the upper arm than the distal guide surface is positioned from the upper arm. Preferably, the apparatus may include a tensioner knob or a tensioner block that may be movably coupled to one or more arms.

20 Claims, 9 Drawing Sheets

(56) References Cited

U.S. PATENT DOCUMENTS

| | | | | | |
|---|---|---|---|---|---|
| 3,717,012 | A * | 2/1973 | Misner | D04C 3/00 | 66/1 A |
| 3,875,878 | A * | 4/1975 | Kaminski | D05B 23/002 | 112/12 |
| 3,967,467 | A * | 7/1976 | Leach, Sr. | D04B 3/00 | 66/4 |
| 4,193,273 | A * | 3/1980 | Palange | D04B 39/00 | 66/4 |
| 4,362,032 | A * | 12/1982 | Palange | D04B 39/00 | 66/4 |
| 4,370,870 | A * | 2/1983 | Kroh | D04B 3/00 | 66/1 A |
| 4,393,668 | A * | 7/1983 | Leach, Sr. | D04B 5/00 | 66/4 |
| 4,635,834 | A * | 1/1987 | Lindquist | D04B 3/06 | 242/146 |
| 6,449,987 | B1 * | 9/2002 | Poole | D04B 3/00 | 66/1 A |
| 12,497,720 | B2 * | 12/2025 | Vela | D04B 33/00 | |
| 2012/0047960 | A1 * | 3/2012 | Sasur | D04B 3/00 | 66/1 A |
| 2016/0032500 | A1 * | 2/2016 | Novak | D04B 5/00 | 28/152 |
| 2023/0183895 | A1 * | 6/2023 | Thorsen | D04B 3/04 | 66/1 A |

* cited by examiner

CROCHET ASSISTANCE APPARATUS

CROSS REFERENCE TO RELATED APPLICATIONS

This application is a continuation-in-part of U.S. Non-Provisional application Ser. No. 18/960,781, filed on Nov. 26, 2024, entitled "CROCHET ASSISTANCE APPARATUS", which is a continuation-in-part of U.S. Non-Provisional application Ser. No. 18/671,464, filed on May 22, 2024, entitled "CROCHET ASSISTANCE APPARATUS", which claims the benefit of U.S. Provisional Patent Application No. 63/470,284, filed on Jun. 1, 2023, entitled "CROCHET ASSIST APPARATUS", the entire disclosures of which are incorporated by reference herein.

FIELD OF THE INVENTION

This patent specification relates to the field of crocheting yarn or other malleable filaments. More specifically, this patent specification relates to a crochet assistance apparatus which enables an individual with movement deficiency in a body part or extremity, e.g., fingers, hands, arms, shoulder, etc., to be able to crochet with pace and accuracy to make the activity enjoyable and fruitful.

BACKGROUND

Crocheting is a very specific art of manipulating yarn and other flexible filaments into various knotted patterns to produce a stretch of material which can be used for clothing, blankets, holders, cloth coverings, or any other product the imagination produces. The various knotted patterns are known as crochet stitches. A row is a series of numbered stitches. Once a crocheter reaches the end of the row, i.e., completes a desired number of stitches, some products are reversed, i.e., flipped direction, and the "next" row is started on the reverse side to create stitches that are unique to crocheting. Other products will continue in a contiguous line or circular pattern to create stitches that are unique to crocheting. This pattern is repeated until the desired number of rows is achieved. Crocheting differs from knitting and other yarn and flexible filament manipulating arts as crocheting is performed with two human hands, a bundle of yarn, and a crochet needle. Each hand has very specific tasks while crocheting. Because crocheting can be performed by either a "right" handed or "left" handed artist the terms "yarn hand" and "needle hand" will allow for ambidextrous nomenclature. This is not to imply that a crocheter could simply switch tasks between hands. Switching the yarn hand with the needle hand or vice versa is as practical as switching which hand one writes with. The needle hand holds a crochet needle, a long handheld cylindrical tool of various thickness with a hook at one end which will aid in manipulating the yarn or other malleable filament into various knotted patterns. The yarn hand provides structure, support, and guidance from the bundle of yarn to the completed product. The yarn hand must provide exacting structure, support, and guidance by fashioning the human fingers into various structures. These various structures require agility, dexterity, stamina, and proper human hand/finger placement knowledge to create the knotted patterns at a pace which makes crocheting an enjoyable task. The yarn hand must 1) hold the completed structure in a usable position, 2) provide support of the yarn for the needle to penetrate the next stitch, and 3) provide yarn guidance so the needle may have the appropriate approach for attack.

Due to illness, injury, or other maladies, one may find their ability to use their needle hand or their yarn hand diminished. At current, there are obvious and existing techniques that will aid those with needle hand deficiencies. Using a simple heavy structure in which a crochet needle is fastened, the artist will use the yarn hand to manipulate the yarn around the statically held needle.

There does not exist an aid, apparatus, structure, or technique that can help those with yarn hand deficiencies. The complexity of tasks the yarn hand must perform simultaneously requires an apparatus that provides 1) structure, 2) support, and 3) guidance with an easy-to-use interface. Beginning crocheters have a steep learning curve to develop the agility, dexterity, stamina, and proper hand/finger placement knowledge of their yarn hand to properly crochet with ease and enjoyment. Existing crocheters may see a decrease in agility, dexterity, or stamina in their hands over time. This is an effort to allow new and existing crocheters the ability to begin or continue their desire to crochet for whatever reason they may have.

My mother, Leticia, is left side hemiplegic due to a stroke and lost the ability to crochet, among other activities. My mother lost one-hundred percent ability to use her yarn hand. My mother has a longing towards enjoying this art again to some degree. I promised her I would attempt to create an apparatus that could help her. I taught myself how to crochet and this apparatus is an effort to allow my mother and others to gain some independence and enjoyment in this art lost to illness, injury, or other maladies.

Therefore, a need exists for novel crochet assistance apparatuses. A further need exists for novel crochet assistance apparatuses which enables a user to crochet and perform like activities to gain some independence and enjoyment in this art that may have been otherwise lost to illness, injury, or other maladies.

BRIEF SUMMARY OF THE INVENTION

A crochet assistance apparatus for supporting a flexible filament is provided which enables a user to crochet and perform like activities to gain some independence and enjoyment in this art that may have been otherwise lost to illness, injury, or other maladies. Preferably, the apparatus may perform one or more, such as all, the functions of a user's "yarn hand" during the performance of crochet and other flexible filament manipulating activities.

In some embodiments, the apparatus may include a base shaft, and a lower arm may be coupled to the base shaft. A central shaft may be coupled to the base shaft, and a central arm may be coupled to the central shaft. A guide shaft may be coupled to the base shaft and the central shaft so that the central shaft is between the guide shaft and the base shaft, and an upper arm and a guide support may be coupled to the guide shaft. The guide support may be positioned to be relatively farther from the central shaft than the upper arm is positioned from the central arm. The guide support may include a distal guide surface and a proximal guide surface, and the proximal guide surface may be positioned to be relatively closer to the upper arm than the distal guide surface is positioned from the upper arm.

In further embodiments, the apparatus may include a tensioner knob that may be movably coupled to one of the lower arm, the central arm, and the upper arm.

In further embodiments, the apparatus may include a tensioner block that may be movably coupled to one or more of the lower arm, the central arm, and the upper arm.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
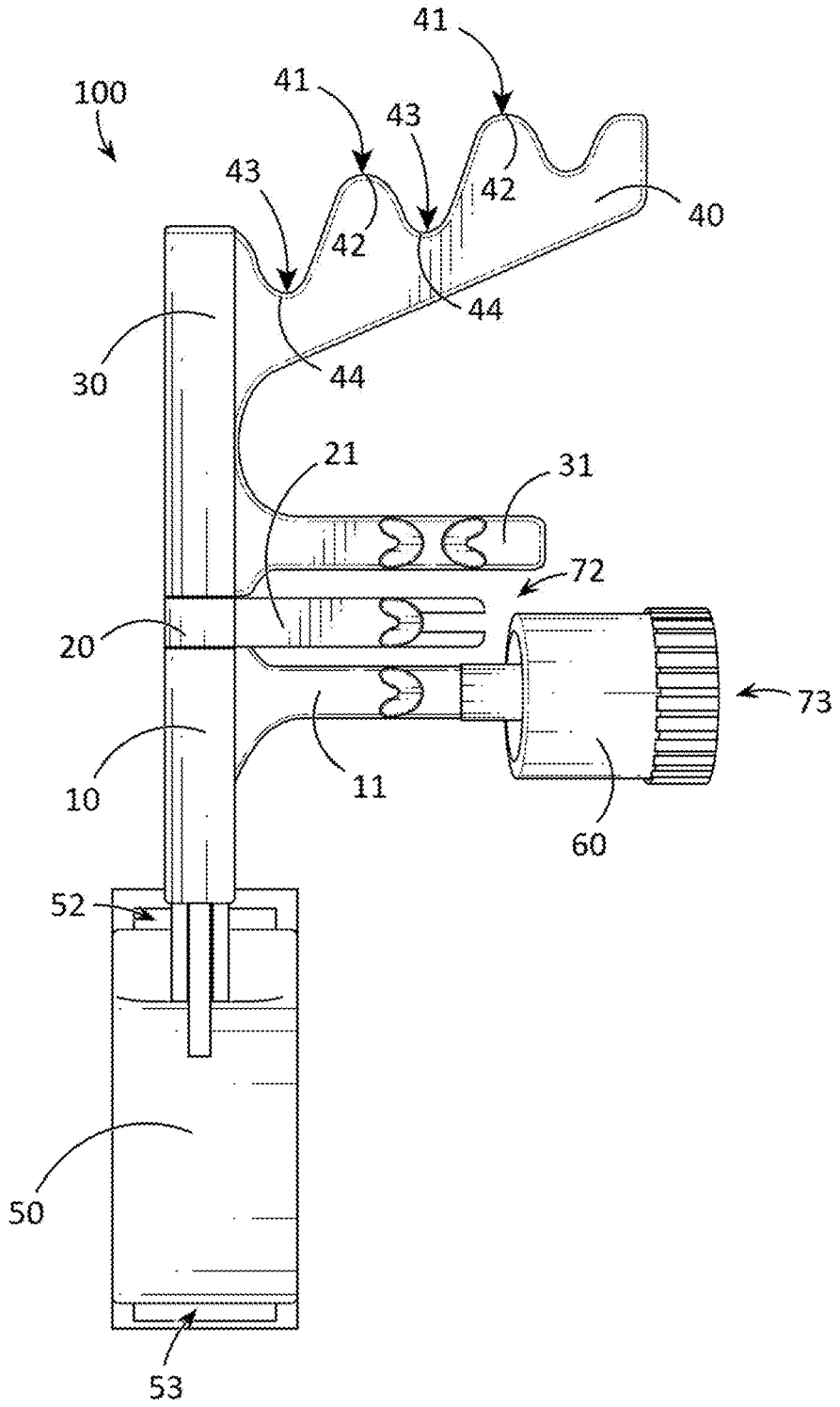
FIG. 1 depicts a front elevation view of an example of a crochet assistance apparatus according to various embodiments described herein.

For purposes of description herein, the terms "upper," "lower," "left," "right," "rear," "front," "side," "vertical," "horizontal," and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 20% of the specified number. Additionally, as used in this application, the term "substantially" means that the actual value is within about 10% of the actual desired value, more preferably within about 5% of the actual desired value and even more preferably within about 1% of the actual desired value of any variable, element or limit set forth herein.

A new crochet assistance apparatus is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1-9 illustrate examples of a crochet assistance apparatus ("the apparatus") 100 according to various embodiments. The apparatus 100 may be used to support a flexible filament 200 to facilitate a user's ability to manipulate the flexible filament 200, such as for performing crochet activities. Preferably, the apparatus 100 may perform one or more, such as all, the functions of a user's "yarn hand" during the performance of crochet and other flexible filament 200 manipulating activities.

Preferably, the apparatus 100 may comprise one or more arms, 11, 21, 31, which may be configured to contact and interact with a flexible filament 200. In some embodiments, the apparatus 100 may comprise a base shaft 10, and a lower arm 11 may be coupled to the base shaft 10. A central shaft 20 may be coupled to the base shaft 10, and a central arm 21 may be coupled to the central shaft 20. A guide shaft 30 may be coupled to the base shaft 10 and the central shaft 20 so that the central shaft 20 is between the guide shaft 30 and the base shaft 10. An upper arm 31 and a guide support 40 may be coupled to the guide shaft 30, and the guide support 40 may be positioned to be relatively farther from the central shaft 20 than the upper arm 31 is positioned from the central arm 21. The guide support 40 may comprise a distal guide surface 41 and a proximal guide surface 43, and the proximal guide surface 43 may be positioned to be relatively closer to the upper arm 31 than the distal guide surface 41 is positioned from the upper arm 31.

In some embodiments, the apparatus 100 may comprise a base 50 that may be coupled to the base shaft 10. Generally, a base 50 may comprise a preferably rigid structure to which the base shaft 10 may be coupled, such as a block or other shape of material. In some embodiments, a base 50 may be made from or may comprise a substantially rigid material, such as aluminum, aluminum alloys, various types of hard plastics, such as polyethylene (PE), Ultra-high-molecular-weight polyethylene (UHMWPE, UHMW), polypropylene (PP) and polyvinyl chloride (PVC), polycarbonate, nylon, Poly(methyl methacrylate) (PMMA) also known as acrylic, melamine, hard rubbers, fiberglass, carbon fiber, resins, such as epoxy resin, wood, other plant based materials, or any other material including combinations of materials that are substantially rigid.

In some embodiments, the apparatus 100 may comprise a securement device 51 that may be configured to be secured to a plurality of support objects. A support object may comprise any object that may support the weight of the apparatus 100, such as: a portion of a user's body, such as around the palm of a user's hand, around a user's wrist, around a user's arm, etc.; a solid structure, such as a table, wall, etc.; or other type of object. In some embodiments, a securement device 51 may be made from or may comprise a flexible material that may conform to the shape of the support object around which the securement device 51 is positioned. Example flexible materials may include polypropylene webbing, polyester webbing, various types of flexible plastics such as polyvinyl chloride, natural rubber, neoprene foam rubber, synthetic rubber material such as latex rubber, forms of the organic compound isoprene, Polyacrylate Rubber, Ethylene-acrylate Rubber, Polyester Urethane, a flexible plastic such as high-density polyethylene (HDPE), polyvinyl chloride (PVC), polypropylene (PP), Polystyrene (PS), Polycarbonate (PC), low density polyethylene (LDPE), synthetic fabrics such as polyester, nylon, rayon, acetate, spandex, spandex blends, and Kevlar, and natural fabrics such as coir, cotton, hemp, jute, canvas, flax, leather, linen, ramie, wool, silk, or any other flexible material.

In preferred embodiments, and in its simplest form, a securement device 51 may be made from an elongated strap of flexible material, such as rope, nylon webbing, leather strap, or the like, which may be positioned around a portion of a support object. For example, a securement device 51 may be made from an elongated strap of flexible material which may be positioned around a portion of a support object that may be the body of a user, such as around their palm. As another example, a flexible securement device 51 may be made from an elongated strap of flexible material which may be positioned around a portion of a support object that may be a solid structure, such as a table, wall, lamp, etc. In further embodiments, a securement device 51 may comprise a glove, full fingered glove, open finger(s) glove, mitten, or the like which may cover and receive all or portions of a user's hand. In further embodiments, a securement device 51 may be configured as a sleeve, harness, or other arrangement of flexible material which may be removably coupled or engaged to a desired portion of a support object. In still further embodiments, a securement device 51 may comprise a substantially rigid material, such as steel alloys, aluminum, aluminum alloys, copper alloys, other types of metal or metal alloys, ceramics such as alumina, porcelain, and boron carbide, earthenware, natural stone, synthetic stone, various types of hard plastics, such as polyethylene (PE), Ultra-high-molecular-weight polyethylene (UHMWPE, UHMW), polypropylene (PP) and polyvinyl chloride (PVC), polycarbonate, nylon, Poly(methyl methacrylate) (PMMA) also known as acrylic, melamine, hard rubbers, fiberglass, carbon fiber, resins, such as epoxy resin, wood, other plant based materials, or any other material including combinations of materials that are substantially rigid and suitable for securing a base to a support object. In still further embodiments, a securement device 51 may comprise a magnetic type fastener, threaded type fastener, sealable tongue and groove fastener, snap fastener, clip type fastener, clasp type fastener, ratchet type fastener, a push-to-lock type connection method, a turn-to-lock type connection method, a slide-to-lock type connection method or any other suitable temporary connection method as one reasonably skilled in the art could envision to serve the same function of coupling the base to a support object.

A base 50 may be coupled to the securement device 51 via any suitable coupling method. For example, a base 50 may be coupled to the securement device 51 via adhesive, heat bonding, via fasteners such as rivets, threaded fasteners, etc., by inserting a portion of the securement device 51 through one or more apertures 52, 53, in the base 50, or any other suitable coupling method. Base apertures 52, 53, may be configured in any size and shape. Preferably, one or more base apertures 52, 53, may be elongated in shape, such as to receive a portion of a strap-type of securement device 51. For example, the base 50 may comprise two elongated base apertures 52, 53, which may each receive a portion of a strap-type of securement device 51.

A base 50 may be coupled to a base shaft 10 via any suitable coupling method. In some embodiments, a base may comprise a shaft aperture 54 which may be sized and shaped to receive a portion of a base shaft 10. A shaft aperture 54 may be configured in any shape and size. Preferably, a shaft aperture 54 may comprise a cross shape which may be complementary in shape to the size and shape of one or more shaft fins 12 that may be formed on the base shaft 10 so that the shaft fins 12 may fit snugly in the shaft aperture 54 while the shaft fins 12 may prevent rotation and may enable selective positioning of the base shaft 10 and its shaft fins 12 in the shaft aperture 54. For example, a base shaft 10 may comprise four shaft fins 12 which may allow up to four different positionings of the base shaft 10 relative to the base depending on the direction that the base shaft 10 is orientated when the shaft fins 12 are inserted into the shaft aperture 54.

In some embodiments, the apparatus may comprise a lower arm 11 that may be coupled to the base shaft 10. A lower arm 11 and a base shaft 10 may be configured in any shape and size. In some embodiments, a lower arm 11 and a base shaft 10 may each comprise an elongated shape, e.g., may be elongated so as to have a length that is significantly greater in dimension than the height and width dimensions. Preferably, a lower arm 11 and a base shaft 10 may each comprise an elongated shape, and the lower arm 11 may be coupled to the base shaft 10 so that the elongated length of the lower arm 11 is substantially perpendicular (plus or minus 10 degrees) to the elongated length of the base shaft 10.

In some embodiments, the apparatus may comprise a central arm 21 that may be coupled to the central shaft 20.

A central arm 21 and a central shaft 20 may be configured in any shape and size. Optionally, a central shaft 20 may be truncated in length compared to the base shaft 10 and guide shaft 30. In some embodiments, a central arm 21 may comprise an elongated shape, e.g., may be elongated so as to have a length that is significantly greater in dimension than the height and width dimensions. Preferably, a central arm 21 may comprise an elongated shape, and the central arm 21 may be coupled to the central shaft 20 so that the elongated length of the central arm 21 is substantially perpendicular (plus or minus 10 degrees) to the truncated length of the central shaft 20.

In some embodiments, the apparatus may comprise an upper arm 31 that may be coupled to the guide shaft 30. An upper arm 31 and a guide shaft 30 may be configured in any shape and size. In some embodiments, an upper arm 31 and a guide shaft 30 may each comprise an elongated shape, e.g., may be elongated so as to have a length that is significantly greater in dimension than the height and width dimensions. Preferably, an upper arm 31 and a guide shaft 30 may each comprise an elongated shape, and the upper arm 31 may be coupled to the guide shaft 30 so that the elongated length of the upper arm 31 is substantially perpendicular (plus or minus 10 degrees) to the elongated length of the guide shaft 30.

In some embodiments, one or more arms 11, 21, 31, may be movable relative to one or more other arms 11, 21, 31. In preferred embodiments, the central arm 21 may be movable relative to the lower arm 11 and/or the upper arm 31 so that the central arm 21 may be movable between an arm open position 71 and an arm closed position 72. Preferably, a central shaft 20 may be movably coupled to the base shaft 10 and/or movably coupled to the guide shaft 30 so that the central shaft 20, and therefore the central arm 21, may be movable relative to the base shaft 10, and its lower arm 11, and/or movable relative to the guide shaft 30, and its upper arm 31. In some embodiments, the base shaft 10 and guide shaft 30 may be elongated in shape and the central shaft 20 and central arm 21 may be pivotable or rotatable around an axis that extends through the elongated lengths of the base shaft 10 and guide shaft 30. In preferred embodiments, the central arm 21 may be movable between an arm open position 71 and an arm closed position 72 via a movable coupling comprising a guide pin 33 that may be inserted through a pivot aperture 26 formed in the central shaft 20 and through a pivot aperture 15 formed in the base shaft 10 so that the central shaft 20 and central arm 21 may pivot and rotate around the guide pin 33.

In some embodiments, the lower arm 11 may comprise an elongated shape, the central arm 21 may comprise an elongated shape, the upper arm 31 may comprise an elongated shape, and the elongated shape of the lower arm 11, the elongated shape of the central arm 21, and the elongated shape of the lower arm 11 may be substantially parallel (plus or minus 10 degrees) to each other when the central arm 21 is in the arm closed position 72.

In some embodiments, the central arm 21 may comprise an arm channel 25 that may be formed into the distal end 22 of the central arm 21 (end of central arm 21 that is most distal to the central shaft 20). An arm channel 25 may be configured in any size and shape. Preferably, an arm channel 25 may comprise a depression or recess in the distal end of the central arm 21 that may be elongated in a direction extending towards the central shaft 20. Preferably, an arm channel 25 may comprise a width and length that may enable a portion of a tensioner knob 60 (e.g., knob ridge 61) to be positioned within the arm channel 25 so that the portion of a tensioner knob 60 (e.g., knob ridge 61) may move into and through the arm channel 25 as the tensioner knob 60 is moved into the knob closed position 74 when the central arm 21 is in the arm closed position 72.

Figure 4:
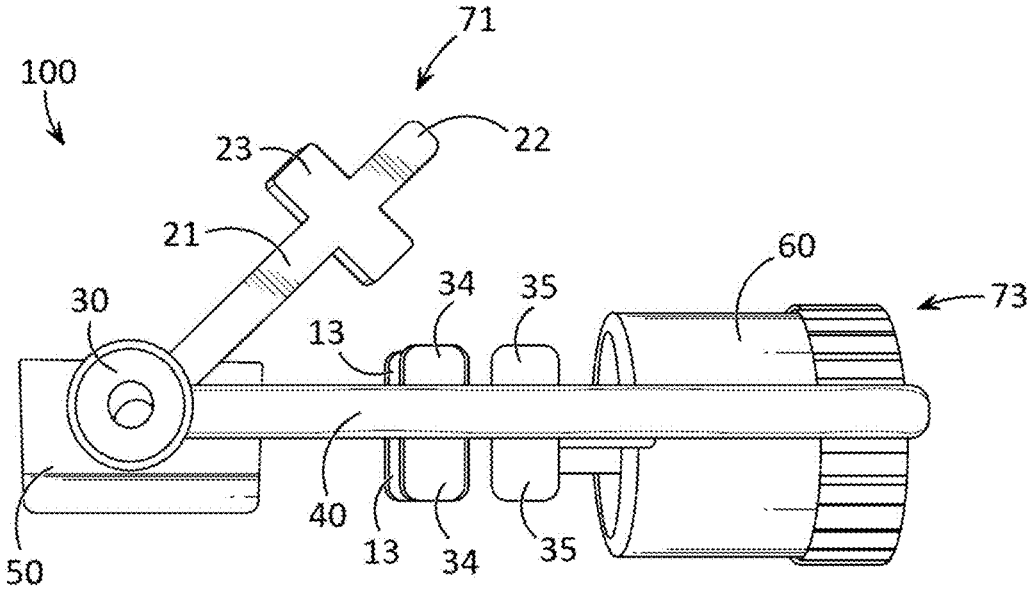
FIG. 4 depicts a top plan view of an example of a crochet assistance apparatus according to various embodiments described herein.
Figure 5:
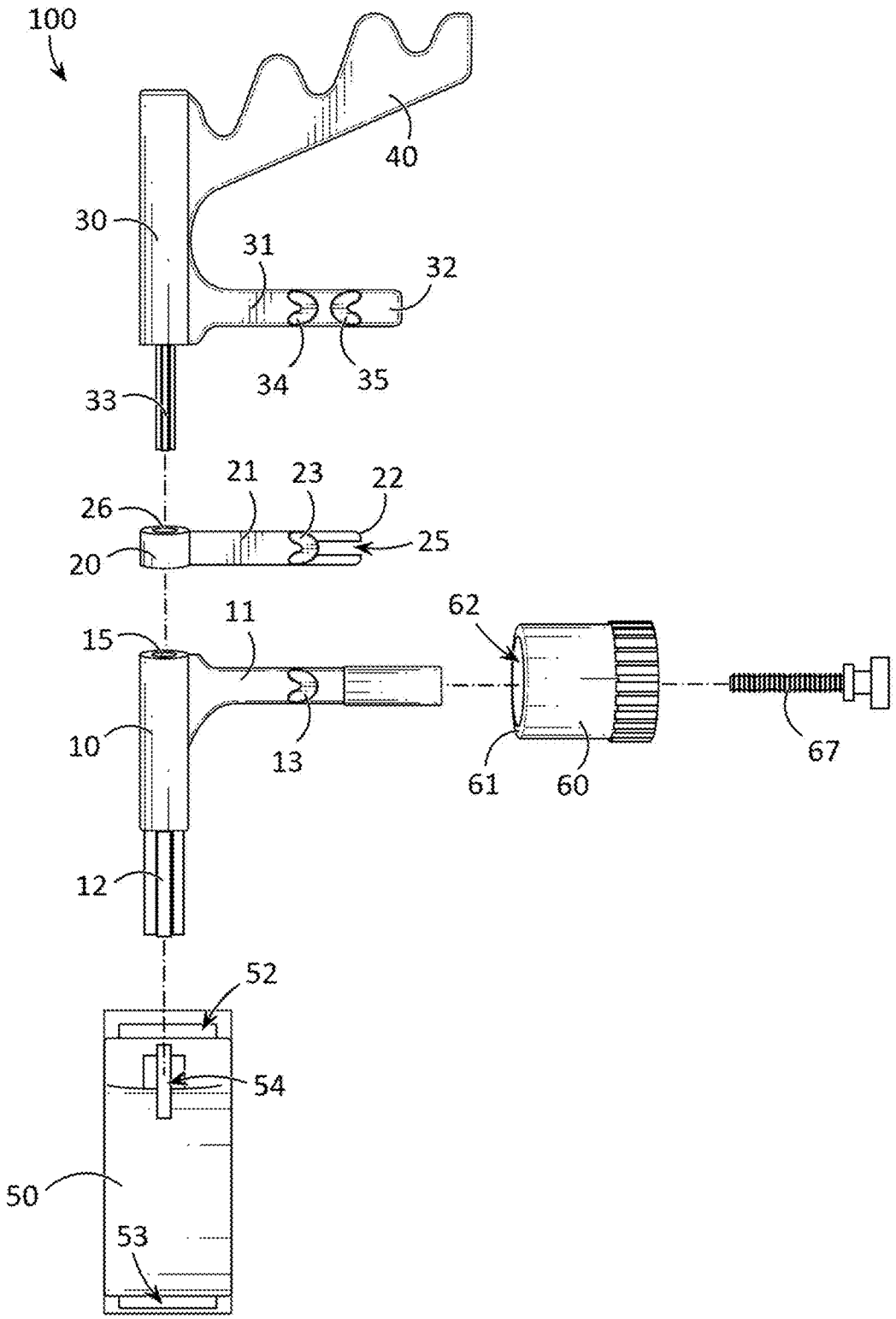
FIG. 5 illustrates an exploded view of an example of a crochet assistance apparatus according to various embodiments described herein.
Figure 6:
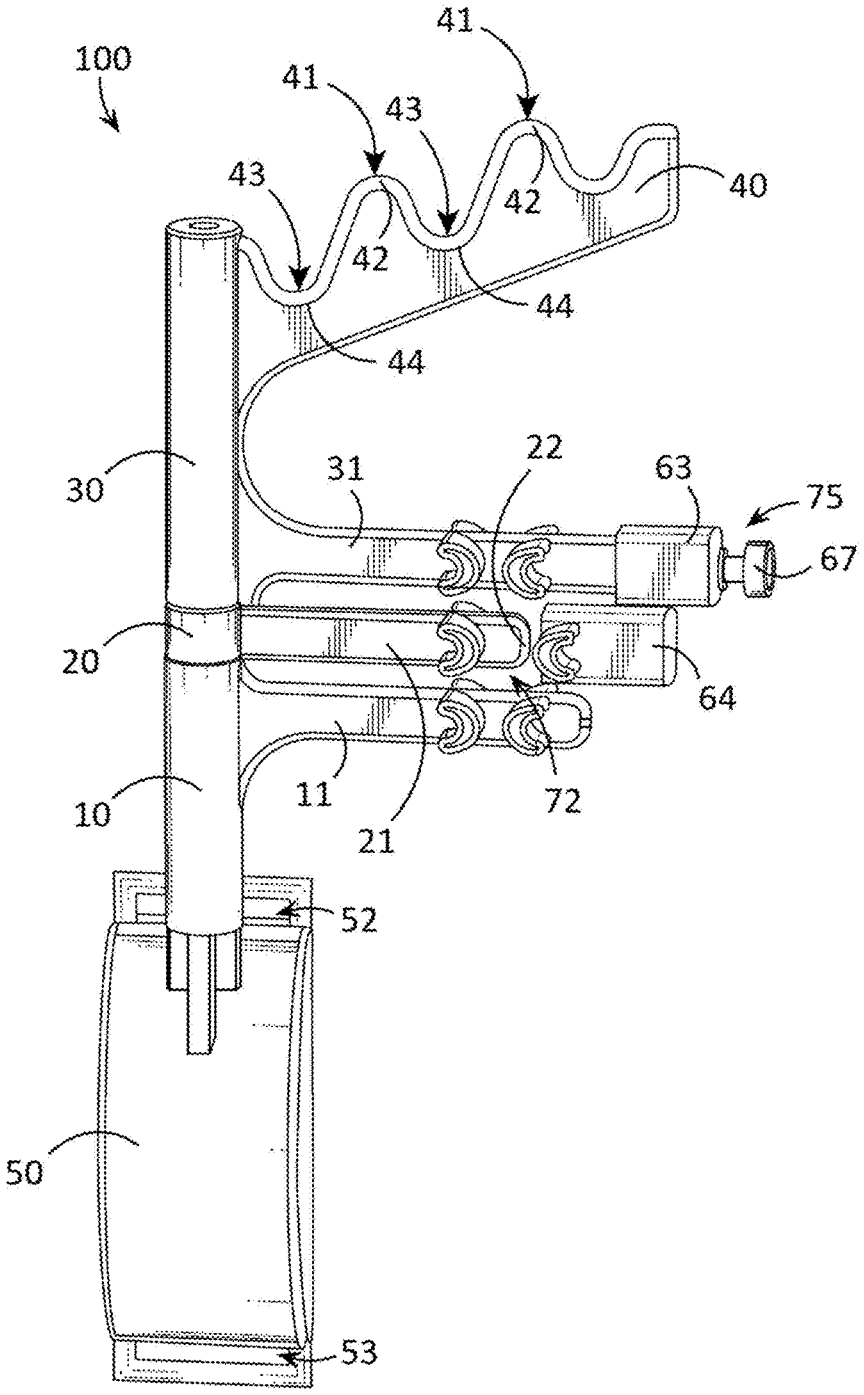
FIG. 6 shows a front elevation view of another example of a crochet assistance apparatus according to various embodiments described herein.

In some embodiments, and as shown in FIGS. 4 and 6, when the central arm 21 is in the arm open position 71 the arm channel 25 may be positioned relatively farther from a tensioner knob 60, and when the central arm 21 is in the arm closed position 72, the arm channel 25 may positioned relatively closer from the tensioner knob 60. In some embodiments, and as shown in FIGS. 1-3, 6, and 7, when the central arm 21 is in the arm closed position 72 the arm channel 25 may be positioned between the upper arm 31 and the lower arm 11, and when the central arm 21 is in the arm open position 71 the arm channel 25 may not be positioned between the upper arm 31 and the lower arm 11. In some embodiments, and as shown in FIGS. 1-3, 6, and 7, when the central arm 21 is in the arm closed position 72 the distal end 22 may be positioned between the upper arm 31 and the lower arm 11, and when the central arm 21 is in the arm open position 71 the distal end 22 may not be positioned between the upper arm 31 and the lower arm 11.

The apparatus 100 may comprise a guide support 40 that may be configured in any shape and size. Preferably, a guide support 40 may support one or more distal guide surfaces 41 and one or more proximal guide surfaces 43, and the one or more proximal guide surfaces 43 may be positioned to be relatively closer to the upper arm 31 than one or more distal guide surfaces 41 may be positioned from the upper arm 31. Preferably, the one or more distal guide surfaces 41 and one or more proximal guide surfaces 43 may extend above the arms 11, 21, 31. Preferably, a distal guide surface 41 may be positioned relatively farther from the upper arm 31 than the one or more proximal guide surfaces 43 that are adjacent to the distal guide surface 41. Likewise, a proximal guide surface 43 may be positioned relatively closer to the upper arm 31 than the one or more distal guide surfaces 41 that are adjacent to the proximal guide surface 43. In some embodiments, the guide support 40 may comprise one or more guide projections 42 and one or more guide depressions 44, and each proximal guide surface 43 may be formed on or by a guide depression 44, while each distal guide surface 41 may be formed on or by a guide projection 42. Preferably, a guide support 40 and an upper arm 31 may each comprise an elongated shape, and the guide support 40 may be coupled to the guide shaft 30 so that the elongated length of the guide support 40 is angled approximately between 20 and 70 degrees above the elongated length of the upper arm 31 and in which the upper arm 31 is coupled approximately perpendicular to the guide shaft 30.

Generally, a guide support 40 may be used to provide guidance for the flexible filament 200 that is being directed or supplied to the hands of a user to have the proper angle for the attacking needle. The guide support 40 may replace or function as the outstretched user finger that holds the yarn or other flexible filament 200 at the proper angle for the attacking needle.

In some embodiments, the apparatus 100 may comprise one or more channel projections 13, 14, 23, 34, 35. Channel projections 13, 14, 23, 34, 35, may be coupled to one or more arms 11, 21, 31. Channel projections 13, 14, 23, 34, 35, may comprise projections or protrusions that may extend away from the arms 11, 21, 31. Channel projections 13, 14, 23, 34, 35, may be configured in any shape and size. In preferred embodiments, channel projections 13, 14, 23, 34, 35, may comprise a curved surface 13A, 14A, 23A, 34A, 35A, that may extend above or away from the arm 11, 21, 31, that each channel projection 13, 14, 23, 34, 35, is coupled to. Preferably, if an arm 11, 21, 31, has two channel projections 13, 14, 23, 34, 35, positioned on the same side of the arm 11, 21, 31, the curved surfaces 13A, 14A, 23A, 34A, 35A, of the channel projections 13, 14, 23, 34, 35, may be concave curved relative to each other. In some embodiments, the apparatus 100 may comprise one or more tensioner projections 68 which may be coupled to the tensioner block 63, such as to an arm block 64. Optionally, tensioner projections 68 may be configured with a similar or same shape as channel projections 13, 14, 23, 34, 35. In some embodiments, a central arm 21 may comprise a channel projection 23 having a curved surface 23A and a tensioner block 63 may comprise a tensioner projection 68 having a curved surface 68A with the channel projection 23 and tensioner projection 68 being placed next to each other when the tensioner block 63 is in the block closed position 76, and the curved surface 23A of the channel projection 23 and the curved surface 68A of the tensioner projection 68 may be concave curved relative to each other.

Generally, channel projections 13, 14, 23, 34, 35, and tensioner projections 68 may provide further surfaces for a flexible filament 200 to contact and move across as the flexible filament 200 moves between the arms 11, 21, 31, and across the guide support 40. Preferably, each arm 11, 21, 31, may comprise one or more channel projections 13, 14, 23, 34, 35. For example, a lower arm 11 may comprise one or more channel projections 13, 14, a central arm 21 may comprise one or more channel projections 23, and an upper arm 31 may comprise one or more channel projections 34, 35.

In some embodiments, the apparatus 100 may comprise one or more tensioner assemblies, such as a tensioner knob 60 and a tensioner block 63, that may be coupled, such as by being movably coupled, to one or more arms 11, 21, 31, of the apparatus 100. Generally, a tensioner knob 60 and a tensioner block 63 may be configured to control the tension of the flexible filament 200 as it moves between the arms 11, 21, 31, towards, and across a proximal guide surface 43 of the guide support 40 so that the flexible filament 200 is not too slack or too tight for the user to add the flexible filament 200 to the working product in a series of stitches. While crocheting, the user will usually wrap the yarn or other flexible filament 200 around their fingers to control how much tension the flexible filament 200 has. Too much tension and the flexible filament 200 will pull the previous stitches apart, too little tension and the needle will not be able to make the appropriate loop or pull.

In some embodiments, and as shown in FIGS. 1-5, the apparatus 100 may comprise a tensioner knob 60 that is movably coupled to one or more of the lower arm 11, the central arm 21, and the upper arm 31. A tensioner knob 60 may be configured in any size and shape. Preferably, a tensioner knob 60 may comprise a generally cylindrical shape and may be movably coupled to an arm 11, 21, 31, so that the axis of its cylinder shape is substantially parallel to the elongated length of the arm 11, 21, 31, that it is coupled to. In some embodiments, a tensioner knob 60 may comprise a knob ridge 61 and/or a knob depression 62 that may be formed into the end of the tensioner knob 60 that is proximal to the base shaft 10. Generally, a knob ridge 61 may comprise an annular ridge or projection that may extend away from a knob depression 62, and a knob depression 62 may comprise an annular depression or recess that extends into the tensioner knob 60 away from the knob ridge 61.

In preferred embodiments, the tensioner knob 60 may be movably coupled to the lower arm 11 so that the tensioner knob 60 may rotate relative to the lower arm 11 and/or the tensioner knob 60 may be movably coupled to the lower arm 11 so that the tensioner knob 60 may be movable towards the base shaft 10 (e.g., into the knob closed position 74) and away from the base shaft 10 (e.g., into the knob open position 73) and a channel projection 13 coupled to the lower arm 11. In preferred embodiments, a tensioner knob 60 may be movably coupled to a distal end of an arm 11, 21, 31, (end of arm 11, 21, 31, farthest from its shaft 10, 20, 30) via threading that may enable the tensioner knob 60 to be moved into and between the knob closed position 74 and knob open position 73 by rotating the tensioner knob 60. For example, the tensioner knob 60 and lower arm 11 may comprise threading that is mated together. As another example, tensioner knob 60 may be movably coupled to a distal end of an arm 11, 21, 31, (end of arm 11, 21, 31, farthest from its shaft 10, 20, 30) via a threaded coupler 67, preferably comprising a threaded shaft, a screw, bolt, etc. As another example, a distal end of an arm 11, 21, 31, (end of arm 11, 21, 31, farthest from its shaft 10, 20, 30) may comprise threading that may be mated with threading on the inside of the tensioner knob 60.

In some embodiments, the lower arm 11 may comprise a channel projection 13, and the tensioner knob 60 may be movable between a knob closed position 74 and a knob open position 73. When the tensioner knob 60 is in the knob closed position 74 the tensioner knob 60 may be positioned relatively closer to the channel projection 13, and when the tensioner knob 60 is in the knob open position 73 the tensioner knob 60 may be positioned relatively farther from the channel projection 13.

In some embodiments, the central arm 21 may comprise an arm channel 25 formed in its distal end and the tensioner knob 60 may comprise a knob ridge 61, and the knob ridge 61 may be positioned within the arm channel 25 when the tensioner knob 60 is in the knob closed position 74. In some embodiments, a portion of the distal end 22 of the central arm 21 may be positioned within the knob depression 62 when the tensioner knob 60 is in the knob closed position 74. In some embodiments, the knob ridge 61 may be removed from the arm channel 25 when the tensioner knob 60 is in the knob closed position 74. In some embodiments, the distal end 22 of the central arm 21 may be removed from the knob depression 62 when the tensioner knob 60 is in the knob closed position 74. In preferred embodiments, the central arm 21 may be maintained in the arm closed position 72 when a portion of the distal end 22 of the central arm 21 is inserted into the knob depression 62 and a portion of the knob ridge 61 is positioned within the arm channel 25 when the tensioner knob 60 is in the knob closed position 74.

In some embodiments, and as shown in FIGS. 6-9, the apparatus 100 may comprise a tensioner block 63 that is movably coupled to one or more of the lower arm 11, the central arm 21, and the upper arm 31. A tensioner block 63 may be configured in any size and shape. Preferably, a tensioner block 63 may comprise a rectangular prism shape. Optionally, a tensioner block 63 may comprise a cylindrical shape, a triangular prism shape, or any other shape. A tensioner block 63 may comprise a first arm aperture 65 and a second arm aperture 66. Optionally, a tensioner block 63 may comprise an arm block 64 into which the second arm aperture 66 may be formed, and the arm block 64 may comprise a rectangular prism shape, cylindrical shape, a triangular prism shape, or any other shape. A first arm aperture 65 may be sized and shape to receive a portion of one arm, such as a distal end 32 of an upper arm 31 (end of upper arm 31 most distal from guide shaft 30), and a second arm aperture 66 may be sized and shape to receive a portion of another arm, such as the distal end 22 of a central arm 21.

In some embodiments, a tensioner block 63 may be movably coupled to the upper arm 31 via a threaded coupler 67, preferably comprising a threaded shaft, a screw, bolt, etc., such that by rotating the threaded coupler 67 in opposing directions the tensioner block 63 may be moved between a block open position 75 and a block closed position 76. In preferred embodiments, the tensioner block 63 may be movably coupled to the upper arm 31 and/or central arm 21 so that the tensioner block 63 may be movable towards one or more of the shafts 10, 20, 30, (e.g., into the block closed position 76) and away from one or more of the shafts 10, 20, 30, (e.g., into the block open position 75).

In some embodiments, the distal end of the central arm 21 is inserted into the second arm aperture 66 when the tensioner block 63 is in the block closed position 76. Preferably, as the tensioner block 63 is moved into the block closed position 76, an increasing amount of a distal end of an arm 11, 21, 31, such as the distal end 32 of the upper arm 31, may be positioned within the first arm aperture 65, and as the tensioner block 63 is moved into the block open position 75, an decreasing amount of a distal end of an arm 11, 21, 31, such as the distal end 32 of the upper arm 31, may be positioned within the first arm aperture 65. Preferably, as the tensioner block 63 is moved into the block closed position 76, an increasing amount of a distal end of an arm 11, 21, 31, such as the distal end 22 of the central arm 21, may be positioned within the second arm aperture 66, and as the tensioner block 63 is moved into the block open position 75, an decreasing amount of a distal end of an arm 11, 21, 31, such as the distal end 22 of the central arm 21, may be positioned within the second arm aperture 66. In preferred embodiments, the central arm 21 may be maintained in the arm closed position 72 when the distal end 22 of the central arm 21 is inserted into the second arm aperture 66 and when the tensioner block 63 is in the block closed position 76.

In some embodiments, the central arm 21 may comprise a channel projection 23 and the tensioner block 63 may comprise a tensioner projection 68 (optionally coupled to the arm block 64). When the tensioner block 63 is in the block closed position 76 the tensioner block 63 and its tensioner projection 68 may be positioned relatively closer to the channel projection 23 on the central arm 21, and when the tensioner block 63 is in the block open position 75 the tensioner block 63 and its tensioner projection 68 may be positioned relatively farther from the channel projection 23 on the central arm 21.

In some embodiments, the apparatus 100 may include a spring 69, such as a coil spring or other type of spring, which may be coupled between two elements, such as the tensioner block 63, a threaded coupler 67, an arm, etc., and so that the spring 69 may tension or bias the tensioner block 63 into one of the block open position 75 and the block closed position 76.

Figure 2:
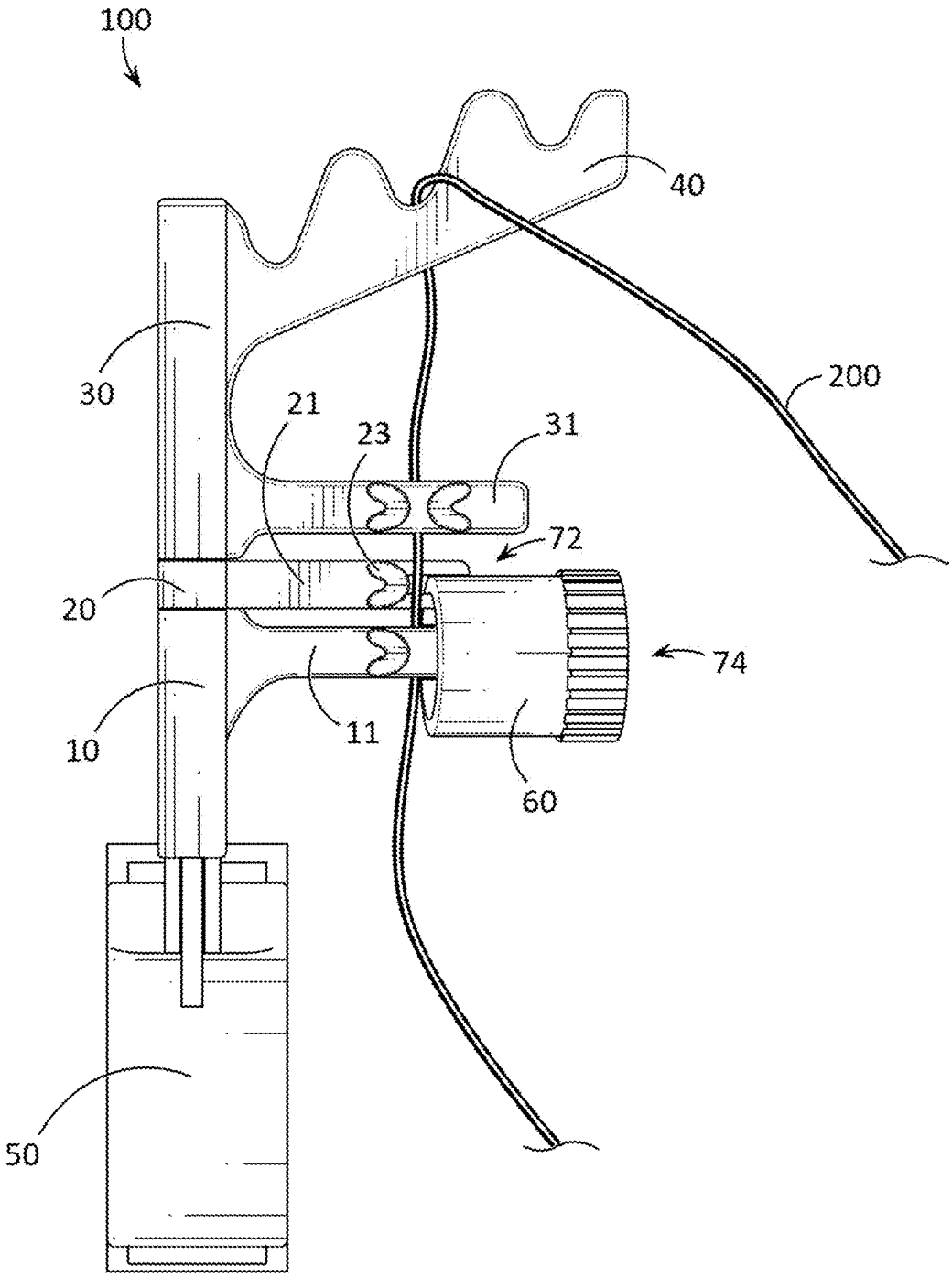
FIG. 2 illustrates a front elevation view of an example of a flexible filament engaged to the crochet assistance apparatus of FIG. 1 according to various embodiments described herein.
Figure 3:
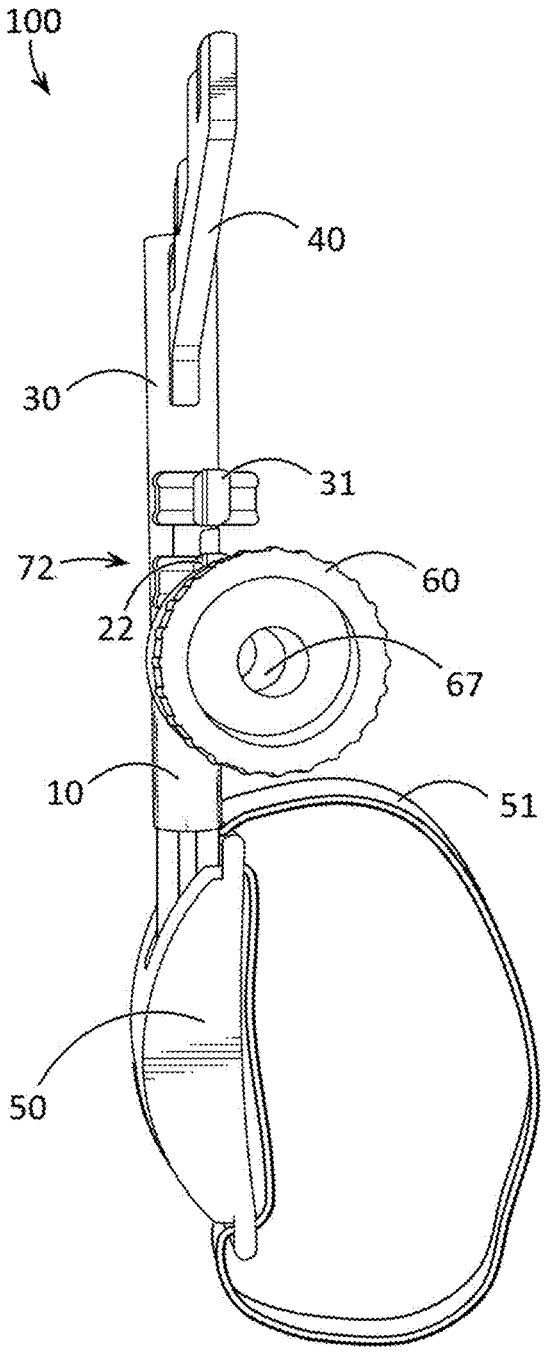
FIG. 3 shows a front elevation view of an example of a crochet assistance apparatus having a securement device according to various embodiments described herein.
Figure 7:
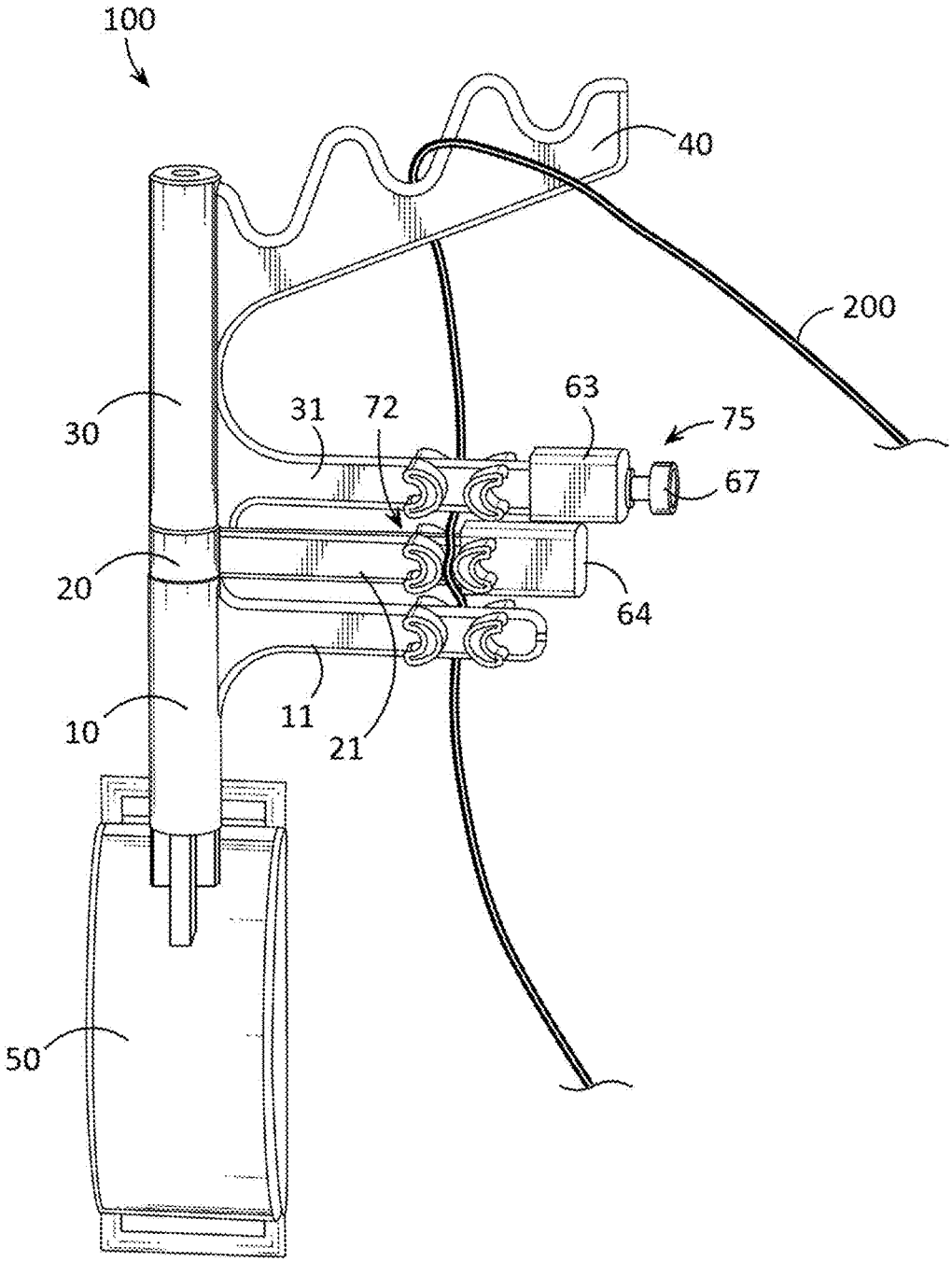
FIG. 7 depicts a front elevation view of an example of a flexible filament engaged to the crochet assistance apparatus of FIG. 6 according to various embodiments described herein.
Figure 8:
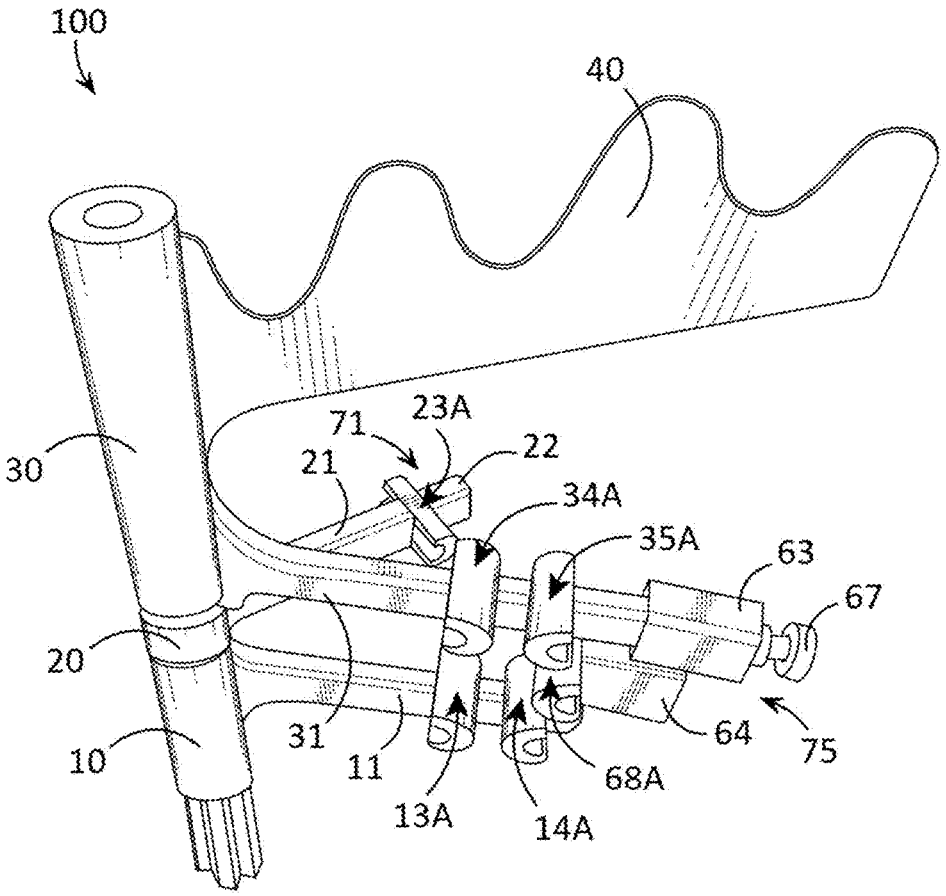
FIG. 8 illustrates a top perspective view of another example of a crochet assistance apparatus according to various embodiments described herein.
Figure 9:
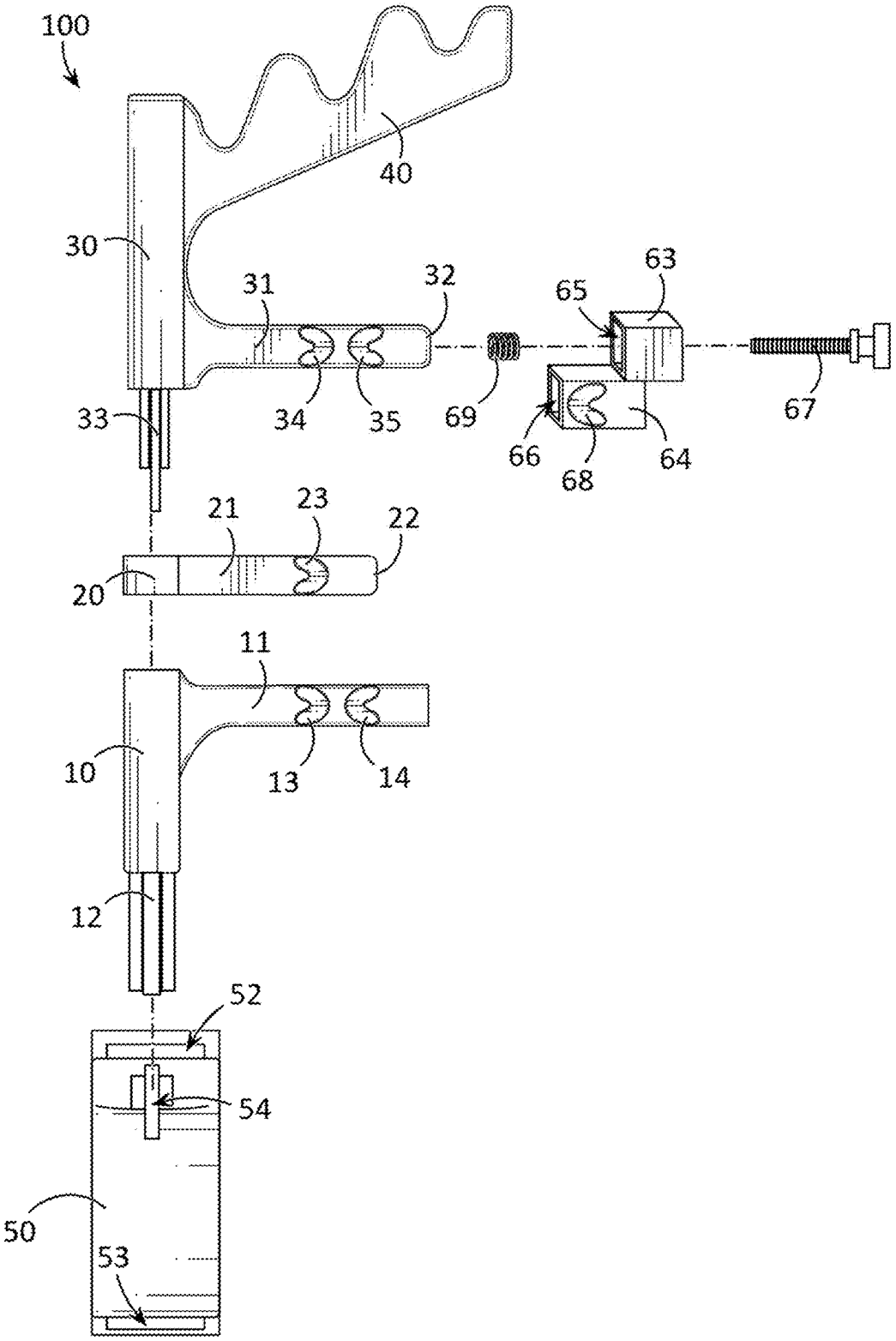
FIG. 9 shows an exploded view of another example of a crochet assistance apparatus according to various embodiments described herein.

In use, the apparatus 100 may be configured to receive a flexible filament 200, so that the flexible filament 200 moves through the arms 11, 21, 31, such as in a serpentine manner, and over a proximal guide surface 43 towards a user's crochet hand. In some embodiments, and as shown in FIG. 2, a tensioner knob 60 may be moved to a desired position between the knob open position 73 and knob closed position 74 so that the knob ridge 61 may squeeze the flexible filament 200 against one or more channel projections 13, 23, so that the tensioner knob 60 may exert a resistance or tension to the flexible filament 200 moving through the apparatus 100 to facilitate and enable the performance of crocheting activities by a user. In some embodiments, and as shown in FIG. 7, a tensioner block 63 may be moved to a desired position between the block open position 75 and block closed position 76 so that the tensioner projection 68 may squeeze the flexible filament 200 against a channel projection 23 of the central arm 21 so that the tensioner block 63 may exert a resistance or tension to the flexible filament 200 moving through the apparatus 100 to facilitate and enable the performance of crocheting activities by a user.

While some exemplary shapes and sizes have been provided for elements of the apparatus 100, it should be understood to one of ordinary skill in the art that the securement device 51, base shaft 10, lower arm 11, central shaft 20, central arm 21, guide shaft 30, upper arm 31, guide support 40, base 50, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the apparatus 100 may be made from or may comprise durable materials such as aluminum, steel, other metals and metal alloys, wood, hard rubbers, hard plastics, fiber reinforced plastics, carbon fiber, fiberglass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the apparatus 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the apparatus 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the apparatus 100 may be coupled by being one of connected to and integrally formed with another element of the apparatus 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A crochet assistance apparatus for supporting a flexible filament, the apparatus comprising:

a base shaft, wherein a lower arm is coupled to the base shaft;

a central shaft coupled to the base shaft, wherein a central arm is coupled to the central shaft;

a guide shaft coupled to the base shaft and the central shaft so that the central shaft is between the guide shaft and the base shaft, wherein an upper arm and a guide support are coupled to the guide shaft, wherein the guide support is positioned to be relatively farther from the central shaft than the upper arm is positioned from the central arm, wherein the guide support comprises a distal guide surface and a proximal guide surface, wherein the proximal guide surface is positioned to be relatively closer to the upper arm than the distal guide surface is positioned from the upper arm;

a channel projection coupled to one of the lower arm, the central arm, and the upper arm; and a tensioner knob that is movably coupled to one of the lower arm, the central arm, and the upper arm, wherein the tensioner knob is movable between a knob closed position and a knob open position, wherein when the tensioner knob is in the knob closed position the tensioner knob is positioned relatively closer to the channel projection, and wherein when the tensioner knob is in the knob open position the tensioner knob is positioned relatively farther from the channel projection.

2. The apparatus of claim 1, wherein the tensioner knob is movably coupled to the lower arm.

3. The apparatus of claim 2, wherein the channel projection is coupled to the lower arm.

4. The apparatus of claim 1, wherein the central arm comprises an arm channel and the tensioner knob comprises a knob ridge, and wherein the knob ridge is positioned within the arm channel when the tensioner knob is in the knob closed position.

5. The apparatus of claim 4, wherein the knob ridge is removed from the arm channel when the tensioner knob is in the knob open position.

6. The apparatus of claim 1, wherein the central arm is movable relative to one of the lower arm and the upper arm.

7. The apparatus of claim 6, wherein the central arm is movable between an arm open position and an arm closed position, wherein the lower arm comprises an elongated shape, wherein the central arm comprises an elongated shape, wherein the upper arm comprises an elongated shape, and wherein the elongated shape of the lower arm, the elongated shape of the central arm, and the elongated shape of the lower arm are substantially parallel to each other when the central arm is in the closed position.

8. The apparatus of claim 6, wherein the central arm comprises an arm channel, wherein the central arm is movable between an arm open position and an arm closed position, wherein when the central arm is in the arm open position the arm channel is positioned relatively farther from the tensioner knob, and wherein when the central arm is in the arm closed position the arm channel is positioned relatively closer from the tensioner knob.

9. The apparatus of claim 6, wherein the central arm comprises an arm channel, wherein the central arm is movable between an arm closed position and an arm open position, wherein when the central arm is in the arm closed position the arm channel is positioned between the upper arm and the lower arm, and wherein when the central arm is in the arm open position the arm channel is not positioned between the upper arm and the lower arm.

10. The apparatus of claim 1, further comprising a base, the base comprising an elongated base aperture.

11. A crochet assistance apparatus for supporting a flexible filament, the apparatus comprising:

a base shaft, wherein a lower arm is coupled to the base shaft;

a central shaft coupled to the base shaft, wherein a central arm is coupled to the central shaft;

a guide shaft coupled to the base shaft and the central shaft so that the central shaft is between the guide shaft and the base shaft, wherein an upper arm and a guide support are coupled to the guide shaft, wherein the guide support is positioned to be relatively farther from the central shaft than the upper arm is positioned from the central arm, wherein the guide support comprises a distal guide surface and a proximal guide surface, wherein the proximal guide surface is positioned to be relatively closer to the upper arm than the distal guide surface is positioned from the upper arm;

a channel projection coupled to one of the lower arm, the central arm, and the upper arm; and a tensioner block that is movably coupled to at least one of the lower arm, the central arm, and the upper arm, wherein the tensioner block comprises a tensioner projection, wherein the tensioner block is movable between a block closed position and a block open position, wherein when the tensioner block is in the block closed position the tensioner projection is positioned relatively closer to the channel projection, and wherein when the tensioner block is in the block open position the tensioner projection is positioned relatively farther from the channel projection.

12. The apparatus of claim 11, wherein the tensioner block is movably coupled to the upper arm.

13. The apparatus of claim 11, wherein the tensioner block is movably coupled to the upper arm via a threaded coupler.

14. The apparatus of claim 11, wherein the channel projection is coupled to the central arm.

15. The apparatus of claim 1, wherein the tensioner block comprises an arm aperture and the central arm comprises a distal end, wherein the tensioner block is movable between a block closed position and a block open position, wherein the distal end is inserted into the arm aperture when the tensioner block is in the block closed position.

16. The apparatus of claim 15, wherein the central arm is maintained in the arm closed position when the distal end is inserted into the arm aperture and when the tensioner block is in the block closed position.

17. The apparatus of claim 11, wherein the central arm is movable relative to one of the lower arm and the upper arm.

18. The apparatus of claim 15, wherein the central arm is movable between an arm open position and an arm closed position, wherein the lower arm comprises an elongated shape, wherein the central arm comprises an elongated shape, wherein the upper arm comprises an elongated shape, and wherein the elongated shape of the lower arm, the elongated shape of the central arm, and the elongated shape of the lower arm are substantially parallel to each other when the central arm is in the closed position.

19. The apparatus of claim 16, wherein the central arm comprises a distal end, wherein the central arm is movable between an arm closed position and an arm open position, wherein when the central arm is in the arm closed position the distal end is positioned between the upper arm and the lower arm, and wherein when the central arm is in the arm open position the distal end is not positioned between the upper arm and the lower arm.

20. The apparatus of claim 11, further comprising a base, the base comprising an elongated base aperture.

* * * * *